US010141147B2

(12) United States Patent
O'Brien

(10) Patent No.: US 10,141,147 B2
(45) Date of Patent: Nov. 27, 2018

(54) TOUCH SAFE PANEL BOARD SYSTEM

(71) Applicant: SCHNEIDER ELECTRIC USA, INC., Schaumburg, IL (US)

(72) Inventor: Daniel O'Brien, La Vergne, TN (US)

(73) Assignee: SCHNEIDER ELECTRIC USA, INC., Andover, MA (US)

( * ) Notice: Subject to any disclaimer, the term of this patent is extended or adjusted under 35 U.S.C. 154(b) by 117 days.

(21) Appl. No.: 15/024,932

(22) PCT Filed: Sep. 30, 2013

(86) PCT No.: PCT/US2013/062552
§ 371 (c)(1),
(2) Date: Mar. 25, 2016

(87) PCT Pub. No.: WO2015/047371
PCT Pub. Date: Apr. 2, 2015

(65) Prior Publication Data
US 2016/0247651 A1 Aug. 25, 2016

(51) Int. Cl.
*H01H 9/02* (2006.01)
*H01R 13/44* (2006.01)
(Continued)

(52) U.S. Cl.
CPC ..... *H01H 71/0214* (2013.01); *H01H 9/0264* (2013.01); *H01H 19/04* (2013.01); *H01H 71/08* (2013.01); *H01R 13/44* (2013.01)

(58) Field of Classification Search
CPC ..... H01H 71/0214; H01H 1/5844; H01H 9/0264; H01R 13/44
(Continued)

(56) References Cited

U.S. PATENT DOCUMENTS 3,404,315 A * 10/1968 Jacobs ..... H01R 13/35 200/294
3,880,494 A * 4/1975 Reed ..... G01R 1/0408 361/670
(Continued)

FOREIGN PATENT DOCUMENTS

EP 2181487 B1 12/2013
WO 2009020487 A1 2/2009

OTHER PUBLICATIONS

International Search Report and Written Opinion dated Feb. 27, 2014 in PCT/US13/62552, 20 pp.
(Continued)

*Primary Examiner* — Felix O Figueroa
(74) *Attorney, Agent, or Firm* — Locke Lord LLP

(57) ABSTRACT

A touch safe electrical panel (100) includes a bus (110) having a branch connector (130) with a vertical stab (132) and a touch safe connection assembly (150). The assembly includes a dielectric housing (152) for the stab. The housing (152) includes a slot (180) through which to receive the stab, and an opening (190), arranged away from the slot, through which to receive a terminal of a plug-on circuit breaker configured to engage the stab. A dielectric barrier (170A, 170B) is arranged in the housing between the slot and the opening. The barrier partially blocks a passage way between the opening and the slot to prevent direct user contact of the stab while enabling the terminal to pass through the partially blocked passage way and engage the stab.

18 Claims, 8 Drawing Sheets

(51) Int. Cl.
*H01H 71/02* (2006.01)
*H01H 19/04* (2006.01)
*H01H 71/08* (2006.01)

(58) Field of Classification Search
USPC ..... 439/691, 839, 693, 374–375
See application file for complete search history.

(56) References Cited

U.S. PATENT DOCUMENTS

| | | | | |
|---|---|---|---|---|
| 4,646,200 | A * | 2/1987 | M'Sadoques | H02B 1/056 361/638 |
| 5,272,592 | A * | 12/1993 | Harris | H02B 1/056 361/637 |
| 6,113,436 | A * | 9/2000 | Kuwahara | H01R 13/44 439/693 |
| 7,005,590 | B1 | 2/2006 | Willis | |
| 7,889,480 | B2 | 2/2011 | Latham | |
| 8,678,849 | B2 * | 3/2014 | Yang | H01R 24/68 439/374 |
| 9,742,161 | B2 * | 8/2017 | Sharp | H02B 1/14 |
| 2008/0087536 | A1 | 4/2008 | Besana et al. | |

OTHER PUBLICATIONS http://news.thomasnet.com/companystory/ABB-ProLine-Family-Becomes-the-only-Panelboard-to-be-Independently-Certified-as-Touch-Safe-Per-IP20-Standards-619193 Press Release, New Berlin Wisconsin, Jul. 16, 2012, 4pp.

* cited by examiner

TOUCH SAFE PANEL BOARD SYSTEM

FIELD

The present disclosure relates to the field of electrical panels for switching equipment, and more particularly, to a touch safe electrical panel having touch safe connection assemblies through which to connecting or disconnect a circuit breaker or other switching equipment.

BACKGROUND

An electrical panel includes live conductors, such as a main bus and individual connection points on the bus (also referred to as "stabs") which are connectable to electrical devices, such as breakers and other switching equipment. When installing or removing an electrical device on the panel, a person may come in direct contact with exposed live conductors—a hazardous situation. Thus, it is recommended that power be shut off to the main bus as a precaution when electrical devices are being installed or removed. Nevertheless, individuals may not always remember to do so or may intentionally keep the power on in the interest of saving time. Moreover, shutting off power to the main bus can be a major inconvenience for both residential and business consumers, but is particularly inconvenient for businesses, such as data centers or hospitals, which rely on a constant source of power to conduct their business affairs.

Furthermore, some plug-on type circuit breakers plug onto or plug off of an electrical panel in one direction. As a result, it is may be necessary to further mechanically secure the circuit breaker to the panel, such as with bolts or screws, which require the use of tools.

SUMMARY

The present disclosure provides a touch safe electrical panel, which prevents a user from coming into contact with a live conductor when engaging or disengaging a terminal device, such as a circuit breaker, to or from the panel. Further, in the situation of installing or removing a circuit breaker with the panel energized, the touch safe electrical panel offers an increased level of protection by eliminating the need for direct contact with energized components. The panel employs dielectric barriers, in front of live bus components such as the bus stabs, to greatly reduce the risk of inadvertent contact with live bus stabs.

The touch safe electrical panel includes a main bus, and one or more branch connectors connected to the bus. Each branch connector includes a vertical stab (also referred to as an "upright" stab). The panel also includes one or more touch safe connection assemblies for housing each stab. More specifically, each touch safe connection assembly includes a dielectric housing for at least a portion of a vertical stab of a branch connector of the panel. The housing includes a slot through which to receive the stab of the electrical panel, and at least one opening arranged away from the slot at an end of the housing. To prevent user contact of the stab, such as with the user's finger, a dielectric barrier is arranged in the housing between the slot and the opening. The barrier partially blocks a passage way between the opening and the slot to prevent direct user contact of the stab. For example, the barrier, in combination with the walls of the housing, blocks the user's finger from reaching the stab located behind the barrier. At the same time, the barrier allows a terminal of a plug-on circuit breaker to pass through the partially blocked passage way around the barrier and engage the stab. The present disclosed touch safe electrical panel can satisfy industry requirements, such as the IP2X test identified in the International Electrotechnical Commission (IEC) Standard 60529 (hereinafter the "IEC 60529 Standard"), which addresses the level of ingress protection. The IP2X test simulates the effects of a person probing with their finger.

In one embodiment, the terminal of the plug-on circuit breaker comprises a clip with two resilient extending arms, which when inserted through the opening are each guided around opposing sides of the barrier and contact opposite sides of the stab. The plug-on circuit breaker can be a bolt-on circuit breaker which is converted with an addition of a plug-on terminal extension. The plug-on terminal extension is formed of a conductive material, and has one end which is connectable to the terminal of the bolt-on circuit breaker, and an opposite end which has the two resilient extending arms. The terminal extension can also include a spring clip which clamps a portion of both extending arms to increase a clamping force of the arms. Thus, existing circuit breakers, such as bolt-on circuit breakers, can be easily converted using the plug-on terminal extension and re-used with the disclosed touch safe electrical panel.

To guide the terminal during insertion, the dielectric barrier can also have a tapered profile which is wider towards an end facing the stab and narrower towards the opening of the housing. The housing can also include other terminal guiding components. For example, a top wall of the housing can have an interior profile (e.g., downward angled profile) that also guides the terminal at an angle through the passage way and past the barrier towards the stab.

Furthermore, to improve connection of a retrofitted bolt-on circuit breaker to the electrical panel, a two step or two connection point installation system and method are provided that does not require bolts or screws or the use of tools. For example, the terminal of the circuit breaker is inserted in a first direction at a downward angle from a side of the panel into the opening of the housing of the touch safe connection assembly on the electrical panel. The terminal is guided by a downward-angled profile of the top wall of the housing to a first connection point where a top portion of the terminal is engaged in a gap between the rib on the top wall of the housing and the top of the stab. The terminal, such as its extending arms, also engages the stab. The circuit breaker is then pushed in a second direction downwards to engage a clip on a bottom back end portion of the circuit breaker perpendicularly onto the rail, which provides a second connection point. The two steps are reversible to remove the circuit breaker from the touch safe connection assembly on the electrical panel. For example, the circuit breaker can be disengaged by pulling the back end of the circuit breaker upwards to disengage the clip from the rail, and then pulling out the circuit breaker from the housing of the touch safe connection assembly.

BRIEF DESCRIPTION OF THE DRAWINGS

The description of the various exemplary embodiments is explained in conjunction with the appended drawings, in which.

DETAILED DESCRIPTION

In accordance with various disclosed embodiments, there is provided a touch safe electrical panel, which includes a plurality of touch safe connection assemblies through which terminal devices, such as circuit breakers or other switching device, are connected to or disconnected from stabs of the electrical panel.

Figure 2:
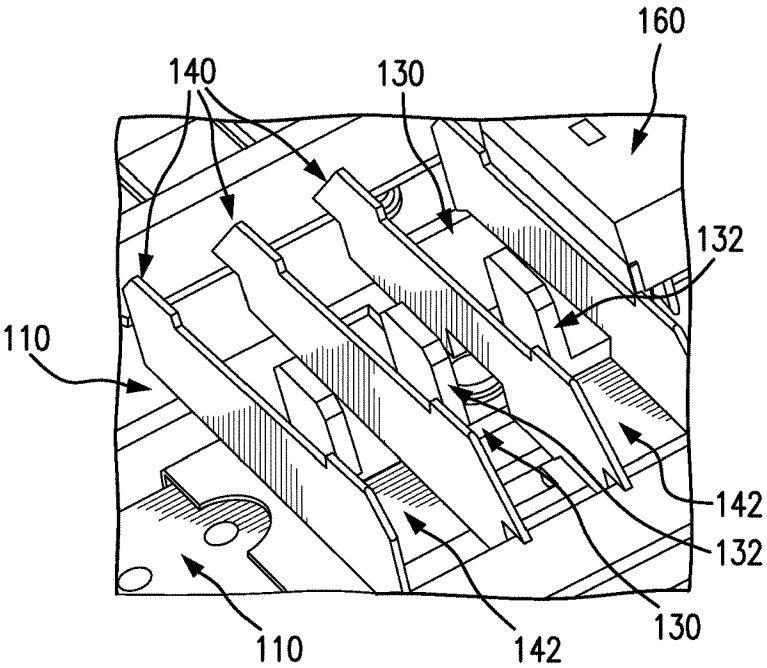
FIG. 2 illustrates another perspective view of a portion of the touch safe electrical panel of FIG. 1 without the touch safe connection assemblies.
Figure 1:
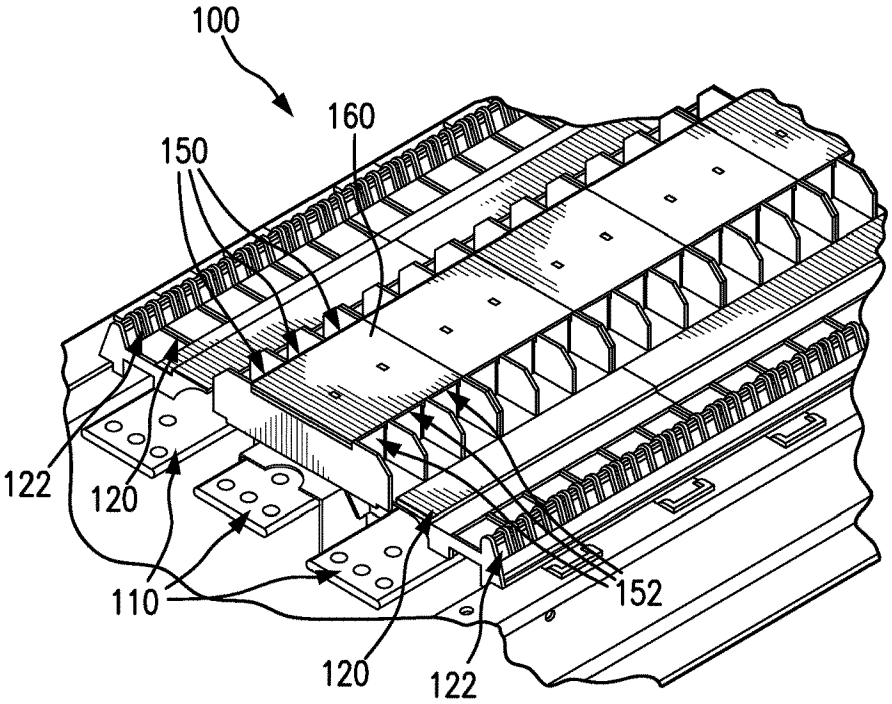
FIG. 1 illustrates a partial perspective view of a touch safe electrical panel that includes a plurality of touch safe connection assemblies through which to connect or disconnect terminal devices, such as circuit breakers or other switching devices, in accordance with an embodiment of the present disclosure.

FIG. 1 illustrates a partial perspective view of a touch safe electrical panel 100 that includes a plurality of buses 110 connectable to a single or multi-phase power supply. As shown in FIG. 2, the buses 110 are connected to branch connectors 130, which have a vertical or upright stab (hereinafter vertical stab). In this example, the stabs 132 of the branch connectors 130 are arranged in a column along a central portion of the electrical panel 100, and are spaced apart and electrically separated from each other by dielectric stab separation barriers 140 and 142. As shown in FIG. 1, the electrical panel 100 also includes a plurality of dielectric touch safe connection assemblies 150, each of which houses one of the stabs 132 (of FIG. 2) and through which to connect or disconnect a terminal of one or more switching devices, such as a circuit breaker, to a stab 132. The electrical panel 100 also includes a pair of dielectric phase barriers 120 on opposite side portions of the panel. Each phase barrier 120 includes a rail 122, which is configured to be engaged by a fastening device, such as a clip, on a bottom of a circuit breaker when the terminal of the circuit breaker is engaged to a stab 132 in the touch safe connection assembly 150. The phase barriers 120 cover portions of the buses 110 or branch connectors 130 located on side portions of the electrical panel 100.

Figure 4:
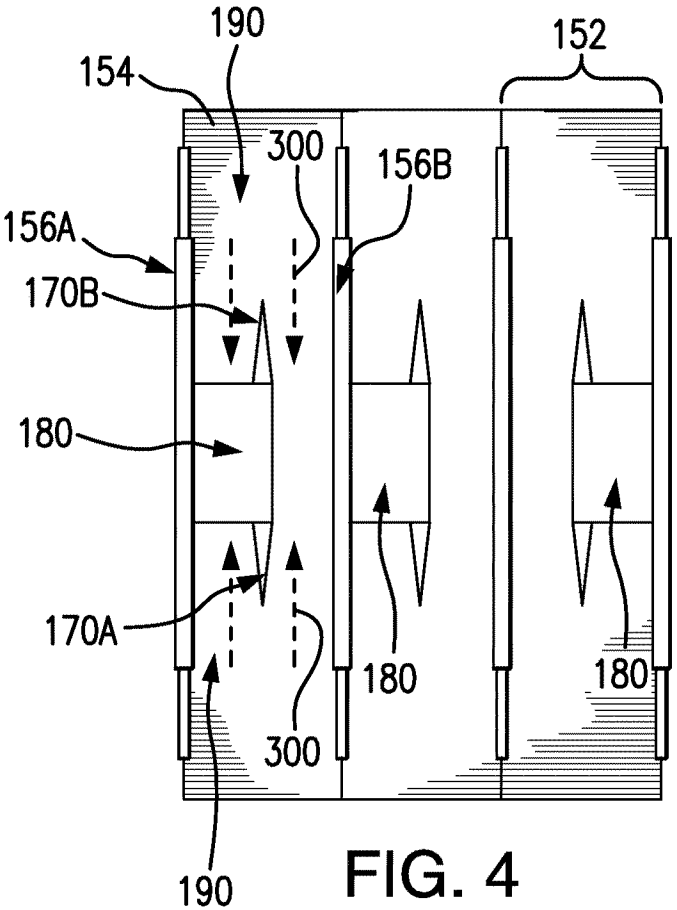
FIG. 4 illustrates a top view of a plurality of touch safe connection assemblies without the stab and the top wall of the housings for a plurality of touch safe connection assemblies.
Figure 3:
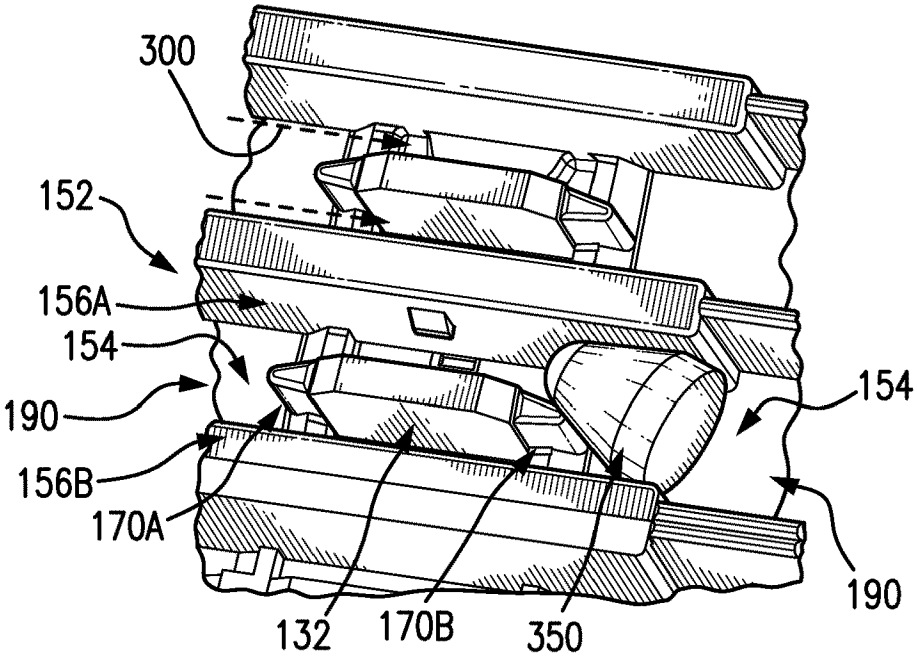
FIG. 3 illustrates a perspective view of a portion of the touch safe electrical panel of FIG. 1, without a top wall of the housings for a plurality of touch safe connection assemblies.

The touch safe connection assembly 150 includes a dielectric housing 152, which has a top wall formed in part by a dielectric cover 160. In this example, each cover 160 forms part of a top wall for three touch safe connection assemblies 150. FIG. 3 illustrates a plurality of touch safe connection assemblies 150 with the top portion cut out. As shown in FIG. 3, the housing 152 of each touch safe connection assembly 150 also includes a dielectric bottom wall 154, and two opposing dielectric sidewalls 156A and 156B. The bottom wall 154 includes a slot 180 (shown in FIG. 4), and two dielectric barriers 170A and 170B. The housing 152 also includes two openings 190, on opposite ends of the housing 152, through which a terminal of a circuit breaker (not shown) can be inserted into the housing 152 and engaged to the stab 132 through a corresponding passage way 300 between one of the openings 190 and one end of the slot 180. The opening may have a diameter of less than or equal to 0.75 inches.

Figure 8:
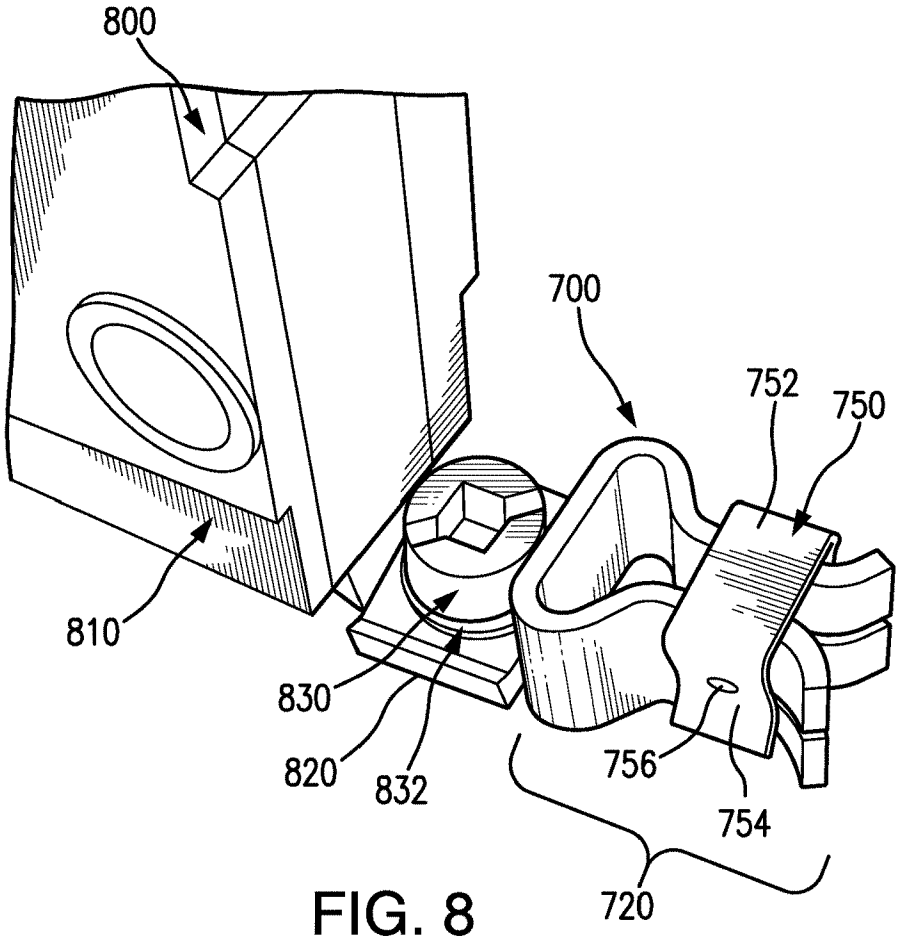
FIG. 8 illustrates a perspective view of a bolt-on circuit breaker with the terminal extension of FIG. 7 to convert the bolt-on terminal to a plug-on terminal, in accordance with an embodiment of the present disclosure.
Figure 7:
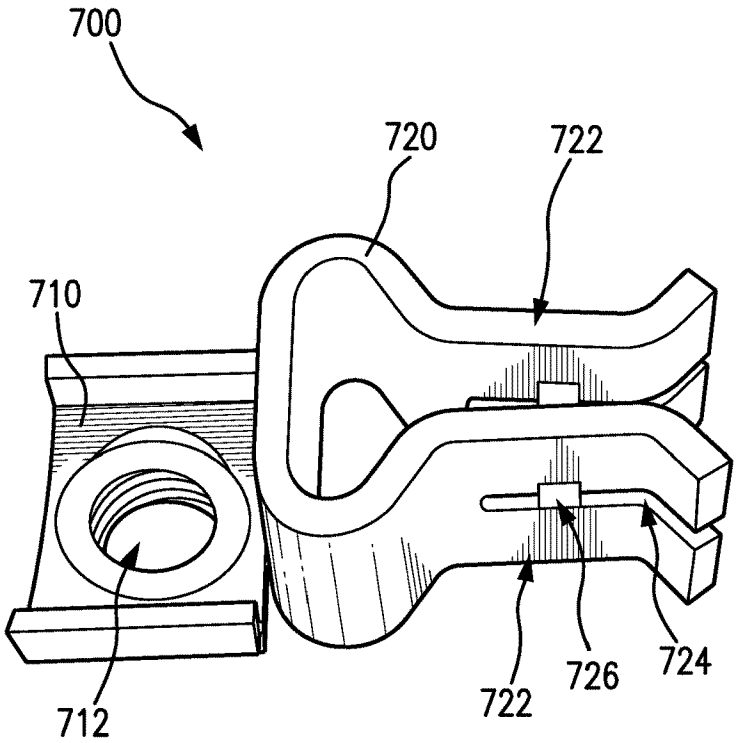
FIG. 7 illustrates a perspective view of a terminal extension which converts a bolt-on terminal, such as for a circuit breaker or other switching device, to a plug-on terminal, in accordance with a disclosed embodiment.
Figure 9:
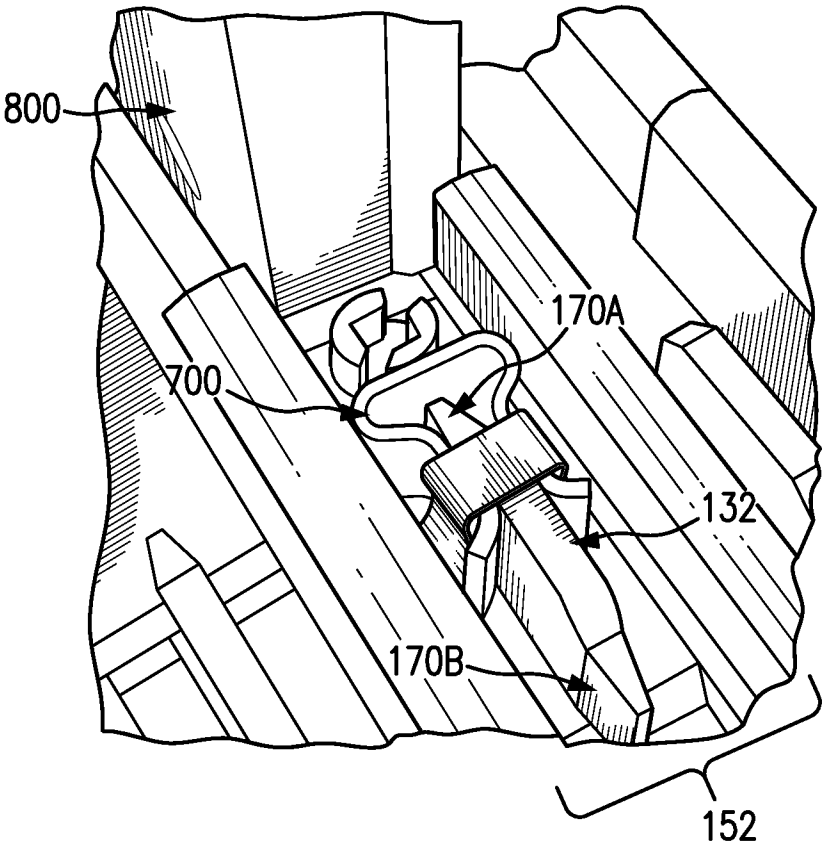
FIG. 9 illustrates a perspective view of the circuit breaker with the terminal extension of FIG. 8 engaged to a stab of the touch safe electrical panel through a touch safe connection assembly (shown without the top portion of the housing of the touch safe connection assembly).

The dielectric barrier 170A is interposed between one of the openings 190 and one side of the slot 180, and the dielectric barrier 170B is interposed between the other of the openings 190 and the other side of the slot 180. Each of the dielectric barriers 170A and 170B may take the form of a post, which has a width that tapers as the post extends toward the opening 190. Each of the dielectric barriers 170A and 170B partially blocks a corresponding passage way 300 between one of the openings 190 and the slot 180 to prevent direct user contact of the stab 132 while enabling a terminal of a circuit breaker, such as of the plug-on circuit breaker, to pass through the partially blocked passage way 300 around the barrier 170A or 170B and to engage the stab 132. As an example, in FIG. 3, a finger-sized object 350 is prevented from contacting the stab 132. Examples of a plug-on terminal of a circuit breaker, which can be used in combination with the touch safe connection assembly, are shown in FIGS. 7 through 9 and discussed further below.

Figure 5:
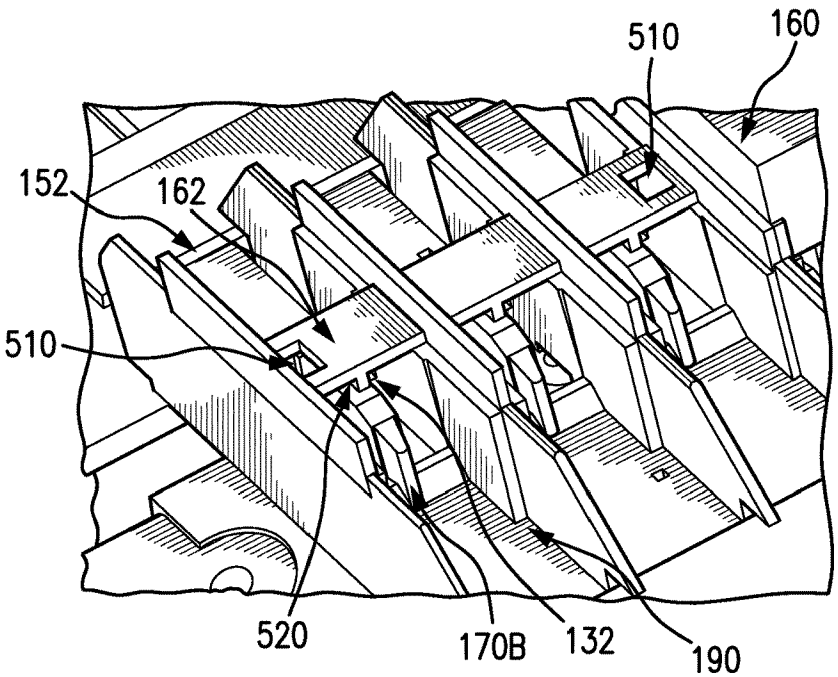
FIG. 5 illustrates another perspective view of a portion of the touch safe electrical panel of FIG. 1, without some of the components, namely a cover that forms part of the top wall of the housing for a plurality of the touch safe connection assemblies.

As shown in FIG. 5, the top wall of the housing 152 of the touch safe connection assembly 150 also includes a dielectric crossbeam 162 in addition to the cover 160. In this example, as with the cover 160, the crossbeam 162 forms part of the top wall for the housing 152 for three of the touch safe connection assemblies 150. The crossbeam 162 includes two cover engagement openings 510 arranged at opposite ends of the crossbeam 162. The crossbeam 162 also includes plurality of ribs 520, each of which is positioned over the slot 180 (or the stab 132 when engaged in the slot 180) in the housing 152 of a corresponding touch safe connection assembly 150. The rib 520, in combination with a top portion of the stab 132, restrains a top portion of the terminal of the circuit breaker from moving upwardly on the stab when the terminal is in the housing and engaged to the stab 132. A gap between the top of the stab and the rib may be provided as further explained below.

Figure 6:
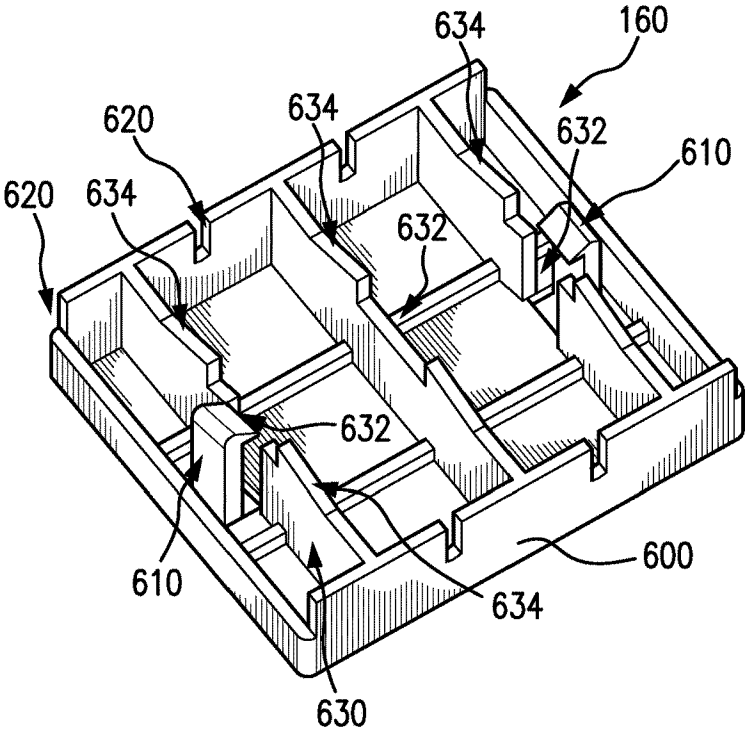
FIG. 6 illustrates a perspective view of a cover for three touch safe connection assemblies, in accordance with a disclosed embodiment.

FIG. 6 illustrates a perspective view of the cover 160. The cover 160 includes a body 600 having two extending arms 610, a plurality of spaced apart grooves 620 on each side of the body 600 and a plurality of beams 630 that extend across the body 600 from one side to an opposite side. Each of the beams 630 includes a central portion with a groove 632 and side portions having a downward-angled profile 634. When assembling the cover 160 onto the other components of the touch safe connection assemblies 150, the two extending arms 610 are engaged to corresponding cover engagement openings 510 of the crossbeam 162 (as shown in FIG. 5) so that portions of the crossbeam 162 is seated in the grooves 632 of the beams 630 of the cover 160. Each beam 630, in combination with a corresponding rib 520 of the crossbeam 162, forms an extended rib. The spaced apart grooves 620 also engage corresponding top portions of the side walls (e.g., 156A or 156B) of the housings 152 for three of the touch safe connection assemblies 150. In this way, the cover 160 in combination with the crossbeam 162 form the top wall for three of the touch safe connection assemblies 150, which is shown more clearly in FIGS. 10 through 12 (discussed further below).

The touch safe connection assembly 150, as disclosed herein, can be configured to satisfy industry requirements, such as those set forth in the IEC 60529 Standard, which addresses the level of ingress protection. For example, the touch safe connection assembly 150, through the housing 152 and the barriers 170A or 170B, are configurable to prevent the following sized objects from contacting the stab 132 through the opening 190: a back of a hand ≥50 mm diameter, a finger ≥12.0 or 12.5 mm diameter, a tool ≥2.0 or 2.5 mm diameter, and a wire ≥1.0 mm diameter.

FIG. 7 illustrates a perspective view of a terminal extension 700 which can be used to convert a bolt-on terminal, such as for a circuit breaker or other switching device, to a plug-on terminal for use with the disclosed electrical panel 100. The terminal extension 700 is formed of a conductive material. As shown in FIG. 7, the terminal extension 700 includes two ends, e.g., a first end portion 710 and a second end portion 720. The first end portion 710 includes a hole 712, e.g., a threaded hole, through which to secure the terminal extension 700 onto a bolt-on terminal of a circuit breaker using bolts or screws. The second end portion 720 includes two resilient extending arms 722 which can be plugged onto a portion of a stab (e.g., the stab 132) so that the extending arms 722 apply a clamping force onto opposing sides of the stab 132. The extending arms 722 together have an hour-glass shape, e.g., they narrow toward each other as they extend outwards and then flare outwards near the ends of the extending arms 722. Each of the extending arms 722 includes a longitudinal slot 724.

As shown in FIG. 8, a circuit breaker 800 includes a breaker body 810 and a bolt-on terminal 820. To convert the circuit breaker 800 to a plug-on circuit breaker, the first portion 720 of the terminal extension 700 is connected to the bolt-on terminal 820 using a washer 820 and a bolt or screw 830. The terminal extension 700 can also include a spring clip 750 that has a top portion 752 and two legs 754 which extend downwards from opposing sides of the top portion 752. The legs 754 of the spring clip 750 can be engaged in corresponding slots 724 of the extending arms 722. For example, each leg 754 of the spring clip 750 can have a punch 756 engaged in a window 756 of a slot 724 of a corresponding extending arm 722. The spring clip 750 can be used to apply additional clamping force to the extending arms 722, when engaging them onto a stab 132 of the electrical panel 100, such as shown in FIG. 9. FIG. 9 also shows that the extending arms 722 along with the spring clip 750 are able to pass around the dielectric barrier, e.g., 170A, and engage the stab 132.

Accordingly, when replacing an electrical panel that uses bolt-on circuit breakers with the disclosed electrical panel 100, the bolt-on circuit breakers (e.g., circuit breaker 800) can be re-used by retro-fitting them with the terminal extensions 700 to convert them to plug-on circuit breakers for use with the electrical panel 100. Of course, the electrical panel 100 can also be used with a plug-on circuit breaker that already has a plug-on terminal with the same or similar configuration as the second portion 720 of the terminal extension 700, or a suitable configuration, e.g., size and shape, to pass around the dielectric barrier 170A or 170B and engage the stab 132.

Figure 10:
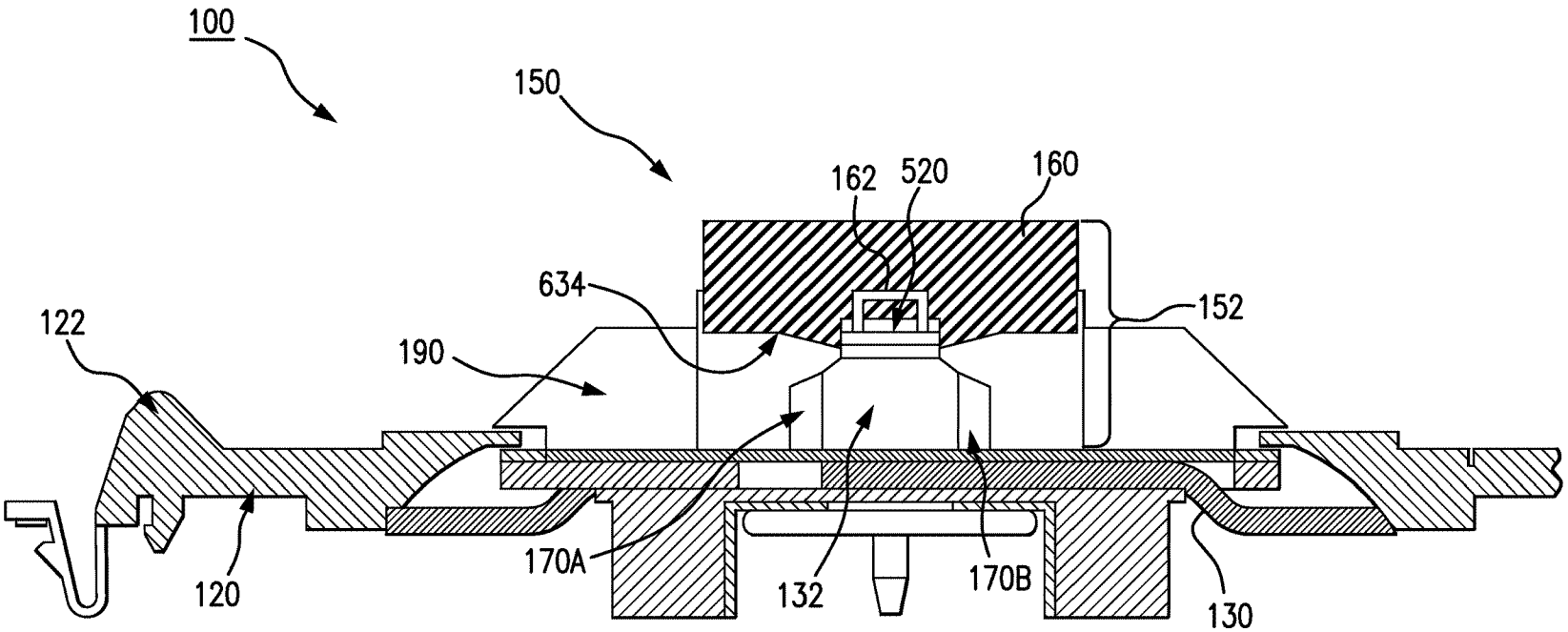
FIG. 10 illustrates a cross-sectional view of the touch safe electrical panel and one of the touch safe connection assemblies of the panel.
Figure 11:
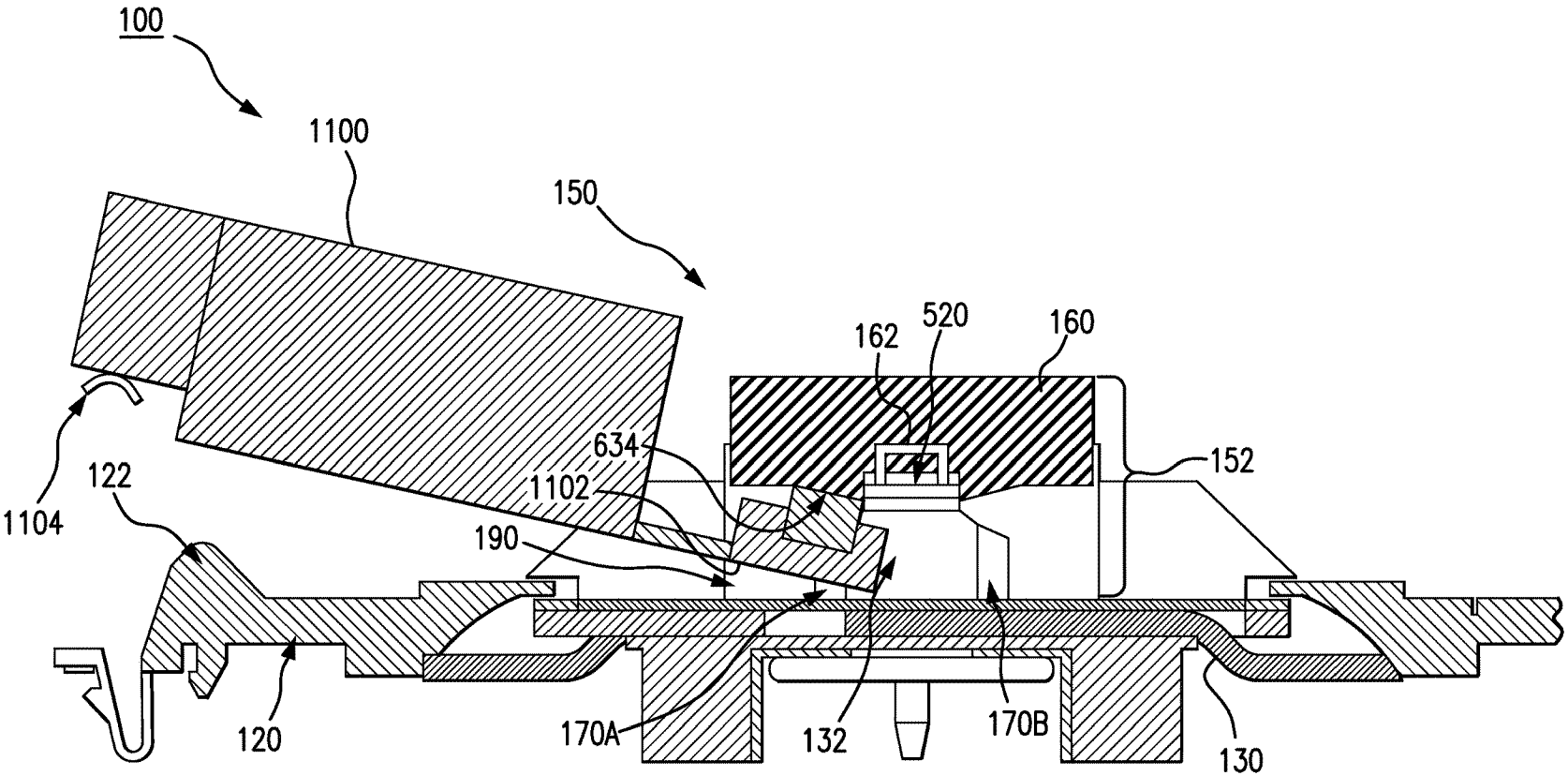
FIG. 11 illustrates the cross-sectional view of the touch safe electrical of FIG. 10 in which a plug-on terminal of a circuit breaker is inserted at an angle in one direction toward a stab housed in the touch safe connection assembly.
Figure 12:
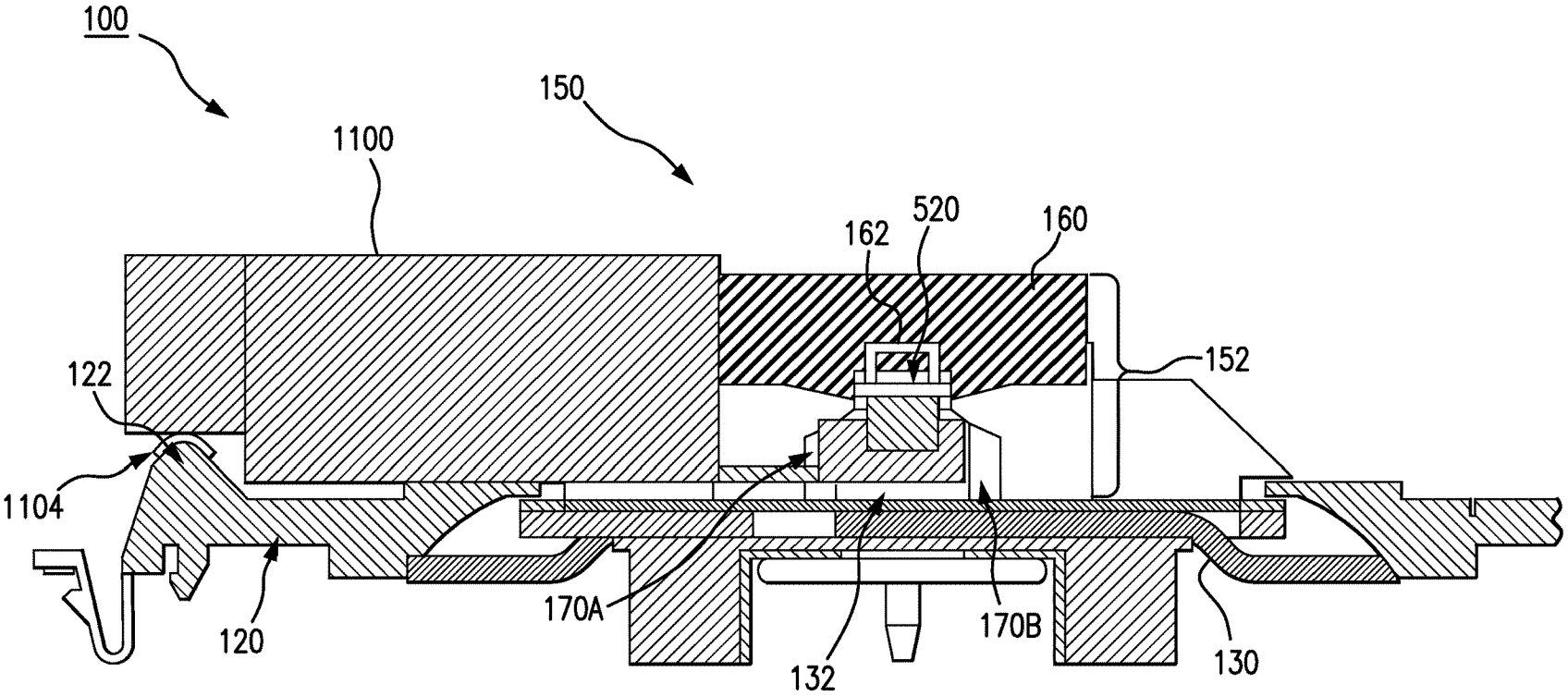
FIG. 12 illustrates the cross-sectional view of the touch safe electrical of FIGS. 10 and 11 in which the plug-on terminal of the circuit breaker is engaged to the stab and the body of the circuit breaker is also connected to a rail on a phase barrier of the panel.

An example of a two-step process will be described below with reference to FIGS. 10 through 12, for engaging a plug-on terminal of a circuit breaker (e.g., the circuit breaker 800 with the terminal extension 700 shown in FIGS. 8 and 9), to the stab 132 housed in one of the touch safe connection assemblies 150 of the electrical panel 100. FIG. 10 illustrates a cross-sectional view of the components of the electrical panel 100 and one of the touch safe connection assemblies 150. As shown in FIG. 11, a circuit breaker 1100 includes a terminal 1102 (e.g., the extending arms 722 and the spring clip 750) and a fastening mechanism 1104, such as a clip, at a back bottom portion of the circuit breaker. In the first step, the terminal 1102 of a circuit breaker 1100 is inserted through one of the openings 190 at a downward angle in a first direction. The terminal 1102 is guided by the downward-angled profile 634 of the top wall of the housing 152 to a first connection point where a top portion of the terminal 1102 (e.g., the top portion of the spring clip 750) is engaged in a gap between the rib 520 on the top wall of the housing 152 and the top of the stab 132. The terminal 1102, such as the extending arms 722, also engages and clamps onto the stab 132 from opposing sides. The circuit breaker 1100 is then pushed in a second direction downwards to engage the fastening mechanism 1104, such as a clip, on a bottom back end portion of the circuit breaker 1100 perpendicularly onto the rail 122, which provides a second connection point. The two steps are reversible to remove the circuit breaker 1100 from the touch safe connection assembly 150 on the electrical panel 100. For example, the circuit breaker 1100 can be disengaged by pulling the back end of the circuit breaker 1100 upwards to disengage the clip 1104 from the rail 122, and then pulling out the circuit breaker 1100 from the housing 152 of the touch safe connection assembly 150.

The various components and configuration of the touch safe connection assembly of the present disclosure may include other components and modifications. For example, the housing of the touch safe connection device can include a latch mechanism such as a spring-loaded tab on an interior side wall opposite the stab, which applies a force against the extending arms of a circuit breaker terminal to further securely engage the terminal to the stab, when connecting the terminal to the stab. The tabs may be connected to a mechanical switch, formed of a dielectric material, which allows the tabs to be pulled back when disconnecting the terminal of the circuit breaker form the stab.

Furthermore, the vertical stab of the electrical panel can be configured with any suitable size and shape. The dielectric barrier that partially blocks the passageway between an opening and the stab also can have any suitable size and shape, can be arranged at any suitable position along the passage way and can extend from or be connected to different interior walls inside the housing depending on the size, shape and configuration of the terminal of the circuit breaker.

In addition, although the cover and crossbeam are shown as forming the top wall for three touch safe connection assemblies, separate covers and crossbeams can also be configured for a single touch safe connection assembly or any number of touch safe connection assemblies as desired. Also, the size and shape of the opening or passageway of the touch safe connection assembly can also be configured, such as constrained or reduced, to limit upward and downward movement of a circuit breaker when inserting the terminal of the circuit breaker into the touch safe connection assembly to engage a bus stab of the electrical panel.

In addition, the cover may be flat (e.g., FIG. 1) or taller (e.g., FIGS. 6, 10, 11 and 12). The components of the housing of the touch safe connection assembly, such as the walls, can also be configured with different shapes and sizes to provide a suitable enclosure to prevent user contact of a housed stab (e.g., FIGS. 3 and 5).

While particular embodiments and applications of the present disclosure have been illustrated and described, it is to be understood that the present disclosure is not limited to the precise construction and compositions disclosed herein and that various modifications, changes, and variations can be apparent from the foregoing descriptions without departing from the spirit and scope of the invention as defined in the appended claims.

The invention claimed is:

1. A touch safe connection assembly for a conductive vertical stab of an electrical panel, comprising:

a dielectric housing for covering the stab, the housing including:

a slot through which to receive the stab in a vertical direction, a top wall arranged over the slot, an opening arranged at an end of the housing and away from the slot through which to receive a terminal of a plug-on circuit breaker in a horizontal direction, and a passage way extending within and along a length of the dielectric housing from the opening to the slot, and a dielectric barrier arranged in the housing between the slot and the opening, the barrier partially blocking the passage way between the opening and the slot, wherein, when the stab is received in the housing through the slot, the housing and the dielectric barrier together prevent direct user contact of the stab while enabling the terminal to pass through the partially blocked passage way around the barrier and to engage the stab.

2. The assembly of claim 1, wherein the housing further comprises:

two opposing side walls;

a bottom wall including the slot and the dielectric barrier;

the top wall having a rib arranged over the slot, the rib in combination with a top portion of the stab being configured to restrain a top portion of the terminal of the circuit breaker from moving toward the top wall when the terminal is engaged to the stab.

3. The assembly of claim 2, wherein the dielectric barrier comprises a post that extends upwards from an interior side of the bottom wall of the housing, and blocks a direct line to the stab from the opening along the passage way.

4. The assembly of claim 2, wherein the rib is on an interior side of the top wall of the housing and has a downward angled profile, the profile being configured to guide a top portion of the terminal of the circuit breaker towards a gap between the rib and the top portion of the stab, when inserting the terminal into the housing via the opening.

5. The assembly of claim 1, wherein the housing includes:

two of the openings comprising a first opening on one end and a second opening at an opposite end, and two of the dielectric barriers comprising:

a first barrier arranged in the housing between the first opening and one end of the slot to partially block a first passage way therebetween to prevent direct user contact of the stab while enabling a terminal of a first circuit breaker to pass through the partially blocked passage way and engage a portion of the stab, and a second barrier arranged in the housing between the second opening and an other end of the slot to partially block a second passage way therebetween to prevent direct user contact of the stab while enabling a terminal of a second circuit breaker to pass through the partially blocked passage way and engage an other portion of the stab.

6. The assembly of claim 5, wherein the first barrier is arranged adjacent to one end of the slot and the second barrier is arranged adjacent to the other end of the slot.

7. The assembly of claim 1, wherein the electrical panel comprises a plurality of stabs and the touch safe connection assembly comprises a plurality of the dielectric housings, each of which is configured to house a corresponding vertical stab of the electrical panel.

8. The assembly of claim 1, wherein a width of the barrier tapers as it extends towards the opening.

9. The assembly of claim 1, wherein the opening has a diameter of less than or equal to 0.75 inches.

10. The assembly of claim 1, wherein the partially blocked passageway is configured to block a finger having a diameter of 12.5 mm or greater from passing therethrough.

11. A touch safe electrical panel comprising:

a bus having a branch connector with a vertical stab; and a touch safe connection assembly comprising:

a dielectric housing for covering the stab, the housing including:

a slot through which to receive the stab in a vertical direction, a top wall arranged over the slot, and an opening, arranged away from the slot, through which to receive a terminal of a plug-on circuit breaker configured to engage the stab in a horizontal direction, and a passage way extending within and along a length of the dielectric housing from the opening to the slot; and a dielectric barrier arranged in the housing between the slot and the opening, the barrier partially blocking the passage way between the opening and the slot, wherein, when the stab is received in the housing through the slot, the housing and the dielectric barrier together prevent direct user contact of the stab while enabling the terminal to pass through the partially blocked passage way and to engage the stab.

12. The panel of claim 11, further comprising a plurality of the touch safe connection assemblies, wherein the bus includes a plurality of the branch connectors, the stabs of the branch connectors being spaced apart and arranged along a column, each stab being housed in one of the touch safe connection assemblies.

13. The panel of claim 12, wherein the housings of each of the touch safe connection assemblies comprises:

two of the openings including a first opening on one end of the housing and a second opening at an opposite end of the housing, and two of the dielectric barriers including:

a first barrier arranged in the housing between the first opening and one end of the slot to partially block a first passage way therebetween to prevent direct user contact of the stab while enabling a terminal of a first circuit breaker to pass through the partially blocked passage way and engage a portion of the stab, and a second barrier arranged in the housing between the second opening and an other end of the slot to partially block a second passage way therebetween to prevent direct user contact of the stab while enabling a terminal of a second circuit breaker to pass through the partially blocked passage way and engage an other portion of the stab.

14. The panel of claim 11, further comprising: the plug-on circuit breaker.

15. The panel of claim 14, wherein the plug-on circuit breaker comprises:

a circuit breaker having a bolt-on terminal; and a conductive terminal extension having a first end and a second end, the first end connectable to the bolt-on terminal of the circuit breaker, the second end having two resilient extending arms configured to pass through the partially blocked passage way in the housing of the touch safe connection assembly and to clamp onto opposing sides of the vertical stab.

16. The panel of claim 15, wherein the plug-on circuit breaker further comprises:

a spring clip that clamps a portion of both extending arms.

17. The panel of claim 14, further comprising a rail, wherein the circuit breaker further includes a clip on a bottom of a body of the circuit breaker, the clip being configured to engage the rail when the terminal is engaged to the stab in the housing.

18. The panel of claim 11, wherein the partially blocked passageway is configured to block a finger having a diameter of 12.5 mm or greater from passing therethrough.

* * * * *